US011332811B2

(12) United States Patent
Nakamura et al.

(10) Patent No.: US 11,332,811 B2
(45) Date of Patent: May 17, 2022

(54) METAL POWDER FOR POWDER METALLURGY, COMPOUND, GRANULATED POWDER, AND SINTERED BODY

(71) Applicant: Seiko Epson Corporation, Tokyo (JP)

(72) Inventors: Hidefumi Nakamura, Hachinohe (JP); Ryo Numasawa, Hachinohe (JP)

(73) Assignee: Seiko Epson Corporation

( * ) Notice: Subject to any disclaimer, the term of this patent is extended or adjusted under 35 U.S.C. 154(b) by 230 days.

(21) Appl. No.: 16/295,477

(22) Filed: Mar. 7, 2019

(65) Prior Publication Data

US 2020/0024704 A1 Jan. 23, 2020

(30) Foreign Application Priority Data

Mar. 8, 2018 (JP) ..... JP2018-042268

(51) Int. Cl.

| | |
|---|---|
| ***C22C 33/02*** | (2006.01) |
| ***B22F 1/00*** | (2006.01) |
| ***B22F 3/10*** | (2006.01) |
| ***C22C 38/02*** | (2006.01) |
| ***C22C 38/04*** | (2006.01) |
| ***C22C 38/44*** | (2006.01) |
| ***C22C 38/48*** | (2006.01) |
| ***B22F 1/10*** | (2022.01) |

(52) U.S. Cl.

CPC ..... *C22C 33/0207* (2013.01); *B22F 1/10* (2022.01); *B22F 3/10* (2013.01); *C22C 38/02* (2013.01); *C22C 38/04* (2013.01); *C22C 38/44* (2013.01); *C22C 38/48* (2013.01); *B22F 2301/35* (2013.01); *B22F 2998/10* (2013.01); *C21D 2211/001* (2013.01)

(58) Field of Classification Search

CPC ..... C22C 33/0207; C22C 38/02; C22C 38/04; C22C 38/44; C22C 38/48; B22F 1/0059; B22F 3/10; B22F 2301/35; B22F 2998/10; C21D 2211/001

See application file for complete search history.

(56) References Cited

U.S. PATENT DOCUMENTS

| | | | | |
|---|---|---|---|---|
| 2008/0089803 | A1* | 4/2008 | Okada | F28F 21/083 420/38 |
| 2010/0272593 | A1 | 10/2010 | Ishikawa et al. | |
| 2015/0252459 | A1* | 9/2015 | Tamura | C22C 38/44 75/232 |

FOREIGN PATENT DOCUMENTS

| | | | | |
|---|---|---|---|---|
| JP | S36-004355 | | 4/1961 | |
| JP | S5140321 | A * | 11/1974 | C22C 38/00 |
| JP | S5038621 | A * | 4/1975 | C21D 6/00 |
| JP | S50149517 | A * | 11/1975 | C33C 38/54 |
| JP | S5137732 | A * | 3/1976 | C21D 6/00 |
| JP | 2003-166003 | A | 6/2003 | |
| JP | 2011-006776 | A | 1/2011 | |
| JP | 2013-163834 | A | 8/2013 | |
| JP | 2015-175054 | A | 10/2015 | |
| JP | 2015-199971 | A | 11/2015 | |
| JP | 2015196837 | A * | 11/2015 | C22C 38/00 |
| JP | 2016-183396 | A | 10/2016 | |

OTHER PUBLICATIONS

JPS5140321A translation (Year: 1976).*
JPS50149517A english translation (Year: 1975).*
JP2015196837A 2015 english translation (Year: 2015).*
JPS5137732A english translation (Year: 1976).*
JPS5038621A english translation (Year: 1975).*
Wilmes et al. ("Effect of niobium and vanadium as an alloying element in tool steels with high chromium content." The Use of Tool Steels: Experience and Re-search 1 (2002): 227-243.) (Year: 2002).*
Kaneko, H. et al., "Solubility of Phosphorus in a and y-Iron", Japan Inst. Met. Mater., 1965, vol. 29, pp. 166-170, with English translation.
Extended European Search Report for Patent Application No. EP 19161027.8, dated Jun. 18, 2019 (6 pages).

* cited by examiner

*Primary Examiner* — Anthony J Zimmer
*Assistant Examiner* — Ricardo D Morales
(74) *Attorney, Agent, or Firm* — Harness, Dickey & Pierce, P.L.C.

(57) ABSTRACT

A metal powder for powder metallurgy contains Fe as a principal component, Cr in a proportion of 11.0 mass % or more and 25.0 mass % or less, Ni in a proportion of 8.0 mass % or more and 30.0 mass % or less, Si in a proportion of 0.20 mass % or more and 1.2 mass % or less, C in a proportion of 0.070 mass % or more and 0.40 mass % or less, Mn in a proportion of 0.10 mass % or more and 2.0 mass % or less, P in a proportion of 0.10 mass % or more and 0.50 mass % or less, and at least one of W and Nb in a proportion of 0.20 mass % or more and 3.0 mass % or less in total.

1 Claim, No Drawings

METAL POWDER FOR POWDER METALLURGY, COMPOUND, GRANULATED POWDER, AND SINTERED BODY

BACKGROUND

1. Technical Field

The present invention relates to a metal powder for powder metallurgy, a compound, a granulated powder, and a sintered body.

2. Related Art

In a powder metallurgy method, a composition containing a metal powder and a binder is molded into a desired shape to obtain a molded body, and the obtained molded body is degreased and sintered, whereby a sintered body is produced. In such a process for producing a sintered body, an atomic diffusion phenomenon occurs among particles of the metal powder, whereby the molded body is gradually densified, resulting in sintering.

For example, JP-A-2013-163834 (Patent Document 1) discloses an exterior member for a portable electronic device made of austenitic stainless steel produced by subjecting a steel plate composed of C: 0.003 to 0.080%, Si: ≤1.00%, Mn: ≤3.0%, P: ≤0.040%, S: ≤0.030%, Ni: 8.5 to 10.5%, Cr: 15 to 20%, Cu: 2.5 to 3.5%, N: 0.01 to 0.06%, Al: ≤0.003%, and Ti: ≤0.003%, with the remainder including Fe and unavoidable impurities to cold forging and cutting processing.

According to the austenitic stainless steel having such a composition, the exterior member simultaneously having both a high strength necessary as the exterior member, and a nonmagnetic property so as not to adversely affect a geomagnetic sensor or the like can be realized.

However, the austenitic stainless steel disclosed in Patent Document 1 has a problem that the strength is not sufficient. In particular, recently, for example, for a communication device such as a smartphone or a tablet terminal, miniaturization and thinning are required as well as high-speed and large-capacity communication. Further, the same request also applies to an automobile component or the like.

In consideration of such circumstances, even in the case where while a component to be used for a communication device, an automobile, or the like is made nonmagnetic, the component is miniaturized and thinned, realization of a sintered body which shows a sufficient strength has been demanded.

SUMMARY

An advantage of some aspects of the invention is to solve the above-mentioned problem and the invention can be implemented as the following application example.

A metal powder for powder metallurgy according to an application example contains Fe as a principal component, Cr in a proportion of 11.0 mass % or more and 25.0 mass % or less, Ni in a proportion of 8.0 mass % or more and 30.0 mass % or less, Si in a proportion of 0.20 mass % or more and 1.2 mass % or less, C in a proportion of 0.070 mass % or more and 0.40 mass % or less, Mn in a proportion of 0.10 mass % or more and 2.0 mass % or less, P in a proportion of 0.10 mass % or more and 0.50 mass % or less, and at least one of W and Nb in a proportion of 0.20 mass % or more and 3.0 mass % or less in total.

DESCRIPTION OF EXEMPLARY EMBODIMENTS

Hereinafter, a metal powder for powder metallurgy, a compound, a granulated powder, and a sintered body according to the invention will be described in detail.

Metal Powder for Powder Metallurgy

First, a metal powder for powder metallurgy according to an embodiment will be described.

In powder metallurgy, a sintered body having a desired shape can be obtained by molding a composition containing a metal powder for powder metallurgy and a binder into a desired shape, followed by degreasing and sintering. According to such a powder metallurgy technique, an advantage that a sintered body with a complicated and fine shape can be produced in a near-net shape, that is, a shape close to a final shape as compared with the other metallurgy techniques is obtained.

The metal powder for powder metallurgy according to the embodiment is a metal powder which contains Fe as a principal component, Cr in a proportion of 11.0 mass % or more and 25.0 mass % or less, Ni in a proportion of 8.0 mass % or more and 30.0 mass % or less, Si in a proportion of 0.20 mass % or more and 1.2 mass % or less, C in a proportion of 0.070 mass % or more and 0.40 mass % or less, Mn in a proportion of 0.10 mass % or more and 2.0 mass % or less, P in a proportion of 0.10 mass % or more and 0.50 mass % or less, and at least one of W and Nb in a proportion of 0.20 mass % or more and 3.0 mass % or less in total.

By using such a metal powder for powder metallurgy, a sintered body which simultaneously achieves both a nonmagnetic property and a high mechanical strength can be produced. Due to this, for example, when the obtained sintered body is applied to at least some of the components to be used in an electronic device, the components which are made nonmagnetic, and also show a sufficient strength even if the components are miniaturized or thinned can be realized. Further, a sintered body to be produced is produced by powder metallurgy, and therefore has high dimensional accuracy and also is capable of omitting secondary processing or suppressing the processing amount.

Hereinafter, the alloy composition of the metal powder for powder metallurgy according to an embodiment will be described in further detail. In the following description, the "metal powder for powder metallurgy" is sometimes simply referred to as "metal powder".

Cr

Cr (chromium) is an element which mainly imparts corrosion resistance to a sintered body to be produced. By using the metal powder containing Cr, a sintered body which can maintain high mechanical characteristics over a long period of time is obtained due to high corrosion resistance.

The content of Cr in the metal powder is set to 11.0 mass % or more and 25.0 mass % or less, but is set to preferably 14.0 mass % or more and 20.0 mass % or less, more preferably 17.0 mass % or more and 19.0 mass % or less. If the content of Cr is less than the above lower limit, the corrosion resistance of the sintered body to be produced may be insufficient depending on the overall composition. On the other hand, if the content of Cr exceeds the above upper limit, the sinterability is deteriorated depending on the overall composition, and therefore, it becomes difficult to increase the density of the sintered body, and thus, the mechanical characteristics of the sintered body may be deteriorated.

Ni

Ni (nickel) is an element which mainly imparts corrosion resistance and heat resistance to a sintered body to be produced. By using the metal powder containing Ni, a sintered body which can maintain high mechanical characteristics over a long period of time even in a severe atmosphere is obtained due to high corrosion resistance and high heat resistance.

The content of Ni in the metal powder is set to 8.0 mass % or more and 30.0 mass % or less, but is set to preferably 8.5 mass % or more and 15.0 mass % or less, more preferably 9.5 mass % or more and 12.0 mass % or less. If the content of Ni is less than the above lower limit, the corrosion resistance or the heat resistance of the sintered body to be produced may not be sufficiently enhanced depending on the overall composition. On the other hand, if the content of Ni exceeds the above upper limit, the balance of the composition is likely to be lost depending on the overall composition, and therefore, the corrosion resistance or the heat resistance of the sintered body to be produced may be deteriorated.

Si

Si (silicon) is an element which mainly imparts corrosion resistance and high mechanical characteristics to a sintered body to be produced. By using the metal powder containing Si, a sintered body which can maintain high mechanical characteristics over a long period of time is obtained due to high corrosion resistance and high mechanical characteristics.

The content of Si in the metal powder is set to 0.20 mass % or more and 1.2 mass % or less, but is set to preferably 0.25 mass % or more and 1.0 mass % or less, more preferably 0.30 mass % or more and 0.50 mass % or less. If the content of Si is less than the above lower limit, the corrosion resistance or the mechanical characteristics of the sintered body to be produced may be deteriorated depending on the overall composition. On the other hand, if the content of Si exceeds the above upper limit, the balance of the composition is likely to be lost depending on the overall composition, and therefore, the corrosion resistance or the mechanical characteristics of the sintered body to be produced may be deteriorated.

C

C (carbon) is an element which causes solid solution hardening as an interstitial element or causes precipitation hardening by a precipitate containing C or another element in a sintered body to be produced. By using the metal powder containing C, a sintered body having high mechanical characteristics is obtained.

Further, C is an austenitizing element. Therefore, by using the metal powder containing C, a sintered body which has an austenite crystal structure and is made nonmagnetic is obtained.

The content of C in the metal powder is set to 0.070 mass % or more and 0.40 mass % or less, but is set to preferably 0.15 mass % or more and 0.35 mass % or less, more preferably 0.20 mass % or more and 0.30 mass % or less. If the content of C is less than the above lower limit, the mechanical characteristics of the sintered body to be produced may be deteriorated or the magnetic permeability thereof may be increased depending on the overall composition. On the other hand, if the content of C exceeds the above upper limit, the balance of the composition is likely to be lost depending on the overall composition, and therefore, the mechanical characteristics of the sintered body to be produced may be deteriorated or the magnetic permeability thereof may be increased.

Mn

Mn (manganese) is an element which mainly generates an austenite crystal structure in a sintered body to be produced and makes the sintered body nonmagnetic. By using the metal powder containing Mn, a sintered body which is made nonmagnetic is obtained.

The content of Mn in the metal powder is set to 0.10 mass % or more and 2.0 mass % or less, but is set to preferably 0.20 mass % or more and 1.5 mass % or less, more preferably 0.30 mass % or more and 1.0 mass % or less. If the content of Mn is less than the above lower limit, the magnetic permeability of the sintered body to be produced may be increased so as to deteriorate the nonmagnetic property depending on the overall composition. On the other hand, if the content of Mn exceeds the above upper limit, the balance of the composition is likely to be lost depending on the overall composition, and therefore, the mechanical characteristics of the sintered body to be produced may be deteriorated or the magnetic permeability thereof may be increased.

P

P (phosphorus) is an element which causes solid solution hardening as an interstitial element or causes precipitation hardening by a precipitate formed by combining with another element in a sintered body to be produced. By using the metal powder containing P, a sintered body having high mechanical characteristics is obtained.

The content of P in the metal powder is set to 0.10 mass % or more and 0.50 mass % or less, but is set to preferably 0.15 mass % or more and 0.35 mass % or less, more preferably 0.20 mass % or more and 0.30 mass % or less. If the content of P is less than the above lower limit, the mechanical characteristics of the sintered body to be produced may be deteriorated depending on the overall composition. On the other hand, if the content of P exceeds the above upper limit, the balance of the composition is likely to be lost depending on the overall composition, and therefore, the mechanical characteristics of the sintered body to be produced may be deteriorated.

W and Nb

Each of W (tungsten) and Nb (niobium) is a ferritizing element, but is an element which makes a great contribution to the mechanical characteristics of a sintered body to be produced among the ferritizing elements. Therefore, by using the metal powder containing an appropriate amount of W or Nb, a sintered body having high mechanical characteristics while maintaining a nonmagnetic property is obtained.

The content of at least one of W and Nb in the metal powder is set such that the total content of W and Nb is set to 0.20 mass % or more and 3.0 mass % or less, but is set to preferably 0.30 mass % or more and 1.5 mass % or less, more preferably 0.50 mass % or more and 1.0 mass % or less. If the total content of W and Nb is less than the above lower limit, the mechanical characteristics of the sintered body to be produced are deteriorated. On the other hand, if the total content of W and Nb exceeds the above upper limit, the magnetic permeability of the sintered body to be produced is increased so as to deteriorate the nonmagnetic property.

Further, when the ratio (mass ratio) of the sum of the content of W and the content of Nb to the content of C is denoted by "(W+Nb)/C", (W+Nb)/C is preferably 0.80 or more and 9.0 or less, more preferably 1.2 or more and 7.0 or less, further more preferably 2.5 or more and 5.0 or less. According to this, the balance between the effect brought about by the addition of C and the effect brought about by the addition of W or Nb can be achieved. Therefore, both the nonmagnetic property and the high strength can be simultaneously achieved at a higher level.

Further, when the ratio (mass ratio) of the sum of the content of W and the content of Nb to the content of P is denoted by "(W+Nb)/P", (W+Nb)/P is preferably 0.80 or more and 12.0 or less, more preferably 1.2 or more and 8.0 or less, further more preferably 2.5 or more and 5.0 or less. According to this, the balance between the effect brought about by the addition of P and the effect brought about by the addition of W or Nb can be achieved. Therefore, both the nonmagnetic property and the high strength can be simultaneously achieved at a higher level.

The metal powder may contain at least one of W and Nb, but preferably contains both W and Nb. According to this, the mechanical characteristics of the sintered body can be particularly enhanced.

The content ratio of W to Nb at this time is not particularly limited, however, when the ratio (mass ratio) of the content of W to the content of Nb is denoted by "W/Nb", W/Nb is preferably 0.50 or more and 2.0 or less, more preferably 0.70 or more and 1.5 or less, further more preferably 0.80 or more and 1.3 or less. When W/Nb is within the above range, the mechanical characteristics of the sintered body can be particularly enhanced.

V

V (vanadium) is an element to be added as needed and is a ferritizing element, but is an element which makes a great contribution to the mechanical characteristics of a sintered body to be produced among the ferritizing elements. Therefore, by using the metal powder containing an appropriate amount of V, a sintered body having high mechanical characteristics while maintaining a nonmagnetic property is obtained.

The content of V in the metal powder is not particularly limited, but is set to preferably 3.0 mass % or less, more preferably 0.30 mass % or more and 1.5 mass % or less, further more preferably 0.50 mass % or more and 1.0 mass % or less. If the content of V is less than the above lower limit, the mechanical characteristics of the sintered body to be produced may be deteriorated depending on the overall composition. On the other hand, if the content of V exceeds the above upper limit, the magnetic permeability of the sintered body to be produced may be increased so as to deteriorate the nonmagnetic property depending on the overall composition.

Mo

Mo (molybdenum) is an element to be added as needed and is a ferritizing element, but is an element which makes a great contribution to the mechanical characteristics of a sintered body to be produced among the ferritizing elements. Therefore, by using the metal powder containing an appropriate amount of Mo, a sintered body having high mechanical characteristics while maintaining a nonmagnetic property is obtained.

The content of Mo in the metal powder is not particularly limited, but is set to preferably 3.0 mass % or less, more preferably 0.30 mass % or more and 1.5 mass % or less, further more preferably 0.50 mass % or more and 1.0 mass % or less. If the content of Mo is less than the above lower limit, the mechanical characteristics of the sintered body to be produced may be deteriorated depending on the overall composition. On the other hand, if the content of Mo exceeds the above upper limit, the magnetic permeability of the sintered body to be produced may be increased so as to deteriorate the nonmagnetic property depending on the overall composition.

In the case where the metal powder contains V or Mo, the total content of W, Nb, V, and Mo is preferably 0.20 mass % or less and 5.0 mass % or less, more preferably 0.30 mass % or more and 3.0 mass % or less, further more preferably 0.50 mass % or more and 2.0 mass % or less.

Fe

Fe (iron) is an element (principal component) whose content is the highest among the elements contained in the metal powder for powder metallurgy according to the embodiment and has a great influence on the characteristics of the sintered body to be produced. The content of Fe is not particularly limited, but is preferably 50.0 mass % or more, more preferably 60.0 mass % or more.

Other Elements

The metal powder for powder metallurgy according to the invention may contain, other than the above-mentioned elements, at least one element of Cu, Al, Ti, N, and B as needed. These elements are inevitably contained in some cases.

Cu (copper) is an element which mainly enhances the corrosion resistance of a sintered body to be produced.

The content of Cu in the metal powder is not particularly limited, but is preferably 7.0 mass % or less, more preferably 1.0 mass % or more and 4.0 mass % or less. By setting the content of Cu within the above range, the corrosion resistance of the sintered body to be produced can be further enhanced without causing a large decrease in the density of the sintered body.

Al (aluminum) is a ferritizing element. Al causes precipitation hardening by a precipitate formed by combining with Ni or another element. Therefore, by using the metal powder containing Al, a sintered body having high mechanical characteristics is obtained.

The content of Al in the metal powder is not particularly limited, but is preferably 4.0 mass % or less, more preferably 0.10 mass % or more and 3.5 mass % or less, further more preferably 0.20 mass % or more and 1.5 mass % or less. By setting the content of Al within the above range, the mechanical characteristics of the sintered body to be produced can be enhanced while suppressing the deterioration of the nonmagnetic property due to the progress of ferritization of the sintered body.

Ti (titanium) is a ferritizing element. Ti is an element which causes precipitation hardening by a compound formed by combining with another element or suppresses grain boundary corrosion. Therefore, by using the metal powder containing Ti, a sintered body having high corrosion resistance and high mechanical characteristics is obtained.

The content of Ti in the metal powder is not particularly limited, but is preferably 4.5 mass % or less, more preferably 0.20 mass % or more and 4.0 mass % or less. By setting the content of Ti within the above range, the corrosion resistance and the mechanical characteristics of the sintered body to be produced can be enhanced while suppressing the deterioration of the nonmagnetic property due to the progress of ferritization of the sintered body.

N (nitrogen) is an element which mainly enhances the mechanical characteristics such as proof stress of a sintered body to be produced.

Further, N is an austenitizing element. Therefore, by using the metal powder containing N, a sintered body which has an austenite crystal structure and is made nonmagnetic is obtained.

The content of N in the metal powder is not particularly limited, but is preferably 1.0 mass % or less, more preferably 0.050 mass % or more and 0.50 mass % or less, further more preferably 0.10 mass % or more and 0.30 mass % or less. By setting the content of N within the above range, the sintered body to be produced can be made nonmagnetic without deteriorating the mechanical characteristics of the sintered body.

In the case where the metal powder to which N is added is produced, for example, a method in which a nitrided raw material is used, a method in which nitrogen gas is introduced into a molten metal, a method in which the produced metal powder is subjected to a nitriding treatment, or the like is used.

B (boron) is an element which mainly enhances the heat resistance of a sintered body to be produced.

The content of B in the metal powder is not particularly limited, but is preferably 0.20 mass % or less, more preferably 0.020 mass % or more and 0.10 mass % or less. By setting the content of B within the above range, a sintered body having high heat resistance is obtained.

In addition thereto, in order to enhance the characteristics of the sintered body, H, Be, S, Co, As, Sn, Se, Zr, Y, Hf, Ta, Te, Pb, or the like may be added to the metal powder for powder metallurgy according to the invention. In this case, the contents of these elements are not particularly limited, but are preferably limited to such an extent that the nonmagnetic property and the high strength of the sintered body described above are not deteriorated, and therefore, the content of each of these elements is preferably less than 0.10 mass %, and even the total content of these elements is preferably less than 0.20 mass %. These elements are also inevitably contained in some cases.

The metal powder for powder metallurgy according to the invention may contain impurities. Examples of the impurities include all elements other than the above-mentioned elements, and specific examples thereof include Li, Na, Mg, K, Ca, Sc, Zn, Ga, Ge, Ag, In, Sb, Pd, Os, Ir, Pt, Au, and Bi. Each of the incorporation ratios of these impurities is preferably set less than the content of each of Cr, Ni, Si, C, Mn, and P. Further, in particular, each of the incorporation ratios of these impurities is preferably less than 0.030 mass %. Further, even the total incorporation ratio of these impurities is preferably less than 0.30 mass %. These impurities do not inhibit the effect as described above as long as the contents thereof are within the above range, and therefore may be intentionally added to the metal powder.

Meanwhile, O (oxygen) may also be intentionally added to or inevitably incorporated in the metal powder, however, the amount thereof is preferably about 0.80 mass % or less, more preferably about 0.50 mass % or less. By controlling the amount of oxygen in the metal powder within the above range, the sinterability is enhanced, and thus, a sintered body having a high density and excellent mechanical characteristics is obtained. The lower limit thereof is not particularly set, but is preferably 0.030 mass % or more from the viewpoint of ease of mass production or the like.

Analysis Method

The compositional ratio of the metal powder for powder metallurgy according to the embodiment can be determined by, for example, Iron and steel—Atomic absorption spectrometric method specified in JIS G 1257 (2000), Iron and steel—ICP atomic emission spectrometric method specified in JIS G 1258 (2007), Iron and steel—Method for spark discharge atomic emission spectrometric analysis specified in JIS G 1253 (2002), Iron and steel—Method for X-ray fluorescence spectrometric analysis specified in JIS G 1256 (1997), gravimetric, titrimetric, and absorption spectrometric methods specified in JIS G 1211 to G 1237, or the like. Specifically, for example, an optical emission spectrometer for solids (spark optical emission spectrometer, model: SPECTROLAB, type: LAVMB08A) manufactured by SPECTRO Analytical Instruments GmbH or an ICP device (model: CIROS-120) manufactured by Rigaku Corporation can be used.

Incidentally, JIS G 1211 to G 1237 are as follows.

JIS G 1211 (2011): Iron and steel—Methods for determination of carbon content

JIS G 1212 (1997): Iron and steel—Methods for determination of silicon content

JIS G 1213 (2001): Iron and steel—Methods for determination of manganese content JIS G 1214 (1998): Iron and steel—Methods for determination of phosphorus content JIS G 1215 (2010): Iron and steel—Methods for determination of sulfur content JIS G 1216 (1997): Iron and steel—Methods for determination of nickel content JIS G 1217 (2005): Iron and steel—Methods for determination of chromium content JIS G 1218 (1999): Iron and steel—Methods for determination of molybdenum content JIS G 1219 (1997): Iron and steel—Methods for determination of copper content JIS G 1220 (1994): Iron and steel—Methods for determination of tungsten content JIS G 1221 (1998): Iron and steel—Methods for determination of vanadium content JIS G 1222 (1999): Iron and steel—Methods for determination of cobalt content JIS G 1223 (1997): Iron and steel—Methods for determination of titanium content JIS G 1224 (2001): Iron and steel—Methods for determination of aluminum content JIS G 1225 (2006): Iron and steel—Methods for determination of arsenic content JIS G 1226 (1994): Iron and steel—Methods for determination of tin content JIS G 1227 (1999): Iron and steel—Methods for determination of boron content JIS G 1228 (2006): Iron and steel—Methods for determination of nitrogen content JIS G 1229 (1994): Steel—Methods for determination of lead content JIS G 1232 (1980): Methods for determination of zirconium in steel JIS G 1233 (1994): Steel—Method for determination of selenium content JIS G 1234 (1981): Methods for determination of tellurium in steel JIS G 1235 (1981): Methods for determination of antimony in iron and steel JIS G 1236 (1992): Method for determination of tantalum in steel JIS G 1237 (1997): Iron and steel—Methods for determination of niobium content Further, when C (carbon) and S (sulfur) are determined, particularly, an infrared absorption method after combustion in a current of oxygen (after combustion in a high-frequency induction heating furnace) specified in JIS G 1211 (2011) is also used. Specifically, a carbon-sulfur analyzer, CS-200 manufactured by LECO Corporation can be used.

Further, when N (nitrogen) and O (oxygen) are determined, particularly, a method for determination of nitrogen content in iron and steel specified in JIS G 1228 (2006) and a method for determination of oxygen content in metallic materials specified in JIS Z 2613 (2006) are also used.

Specifically, an oxygen-nitrogen analyzer, TC-300/EF-300 manufactured by LECO Corporation can be used.

Further, it is preferred that in the metal powder for powder metallurgy according to the embodiment, an austenite crystal structure is contained. The austenite crystal structure imparts high corrosion resistance to a sintered body and also imparts large elongation thereto. Therefore, the metal powder for powder metallurgy having such a crystal structure can produce a sintered body having high corrosion resistance and large elongation.

Further, also such a sintered body contains an austenite crystal structure, and therefore, has a low magnetic permeability and exhibits a favorable nonmagnetic property. Therefore, a sintered body which is favorably used as a material for a component to be used for, for example, a communication device or the like. Further, for the sintered body, cold working is not needed or the processing amount can be minimized in the production process, and therefore, magnetization accompanying cold working is avoided. Due to this, also from this viewpoint, a sintered body which exhibits a favorable nonmagnetic property is obtained.

It can be determined whether or not the metal powder for powder metallurgy and the sintered body according to the embodiment have an austenite crystal structure by, for example, X-ray diffractometry.

The average particle diameter of the metal powder for powder metallurgy according to the embodiment is preferably 0.50 μm or more and 50.0 μm or less, more preferably 1.0 μm or more and 30.0 μm or less, further more preferably 2.0 μm or more and 10.0 m or less. By using the metal powder for powder metallurgy having such a particle diameter, pores remaining in a sintered body are extremely reduced, and therefore, a sintered body having a high density and excellent mechanical characteristics can be produced.

The average particle diameter of the metal powder for powder metallurgy can be obtained as a particle diameter when the cumulative amount from the small diameter side reaches 50% in a cumulative particle size distribution on a mass basis obtained by laser diffractometry.

If the average particle diameter of the metal powder for powder metallurgy is less than the above lower limit, the moldability is deteriorated when molding the shape which is difficult to mold, and therefore, the sintered density may be decreased. On the other hand, if the average particle diameter of the metal powder exceeds the above upper limit, the gaps between the particles become larger during molding, and therefore, the sintered density may be decreased also in this case.

The particle size distribution of the metal powder for powder metallurgy is preferably as narrow as possible. Specifically, when the average particle diameter of the metal powder for powder metallurgy is within the above range, the maximum particle diameter of the metal powder is preferably 200 m or less, more preferably 150 μm or less. By controlling the maximum particle diameter of the metal powder for powder metallurgy within the above range, the particle size distribution of the metal powder for powder metallurgy can be further narrowed, and thus, the density of the sintered body can be further increased.

The "maximum particle diameter" refers to a particle diameter when the cumulative amount from the small diameter side reaches 99.9% in a cumulative particle size distribution on a mass basis obtained by laser diffractometry.

When the minor axis of each particle of the metal powder for powder metallurgy is represented by S (μm) and the major axis thereof is represented by L (μm), the average of the aspect ratio defined by S/L is preferably about 0.4 or more and 1 or less, more preferably about 0.7 or more and 1 or less. The metal powder for powder metallurgy having such an aspect ratio has a shape relatively close to a spherical shape, and therefore, the packing factor when the metal powder is molded is increased. As a result, the density of the sintered body can be further increased.

The "major axis" is the maximum possible length in the projected image of the particle, and the "minor axis" is the maximum possible length in the direction perpendicular to the major axis. Further, the average of the aspect ratio is obtained as the average of the values of the aspect ratio measured for 100 or more particles.

The tap density of the metal powder for powder metallurgy slightly varies depending on the composition, but is preferably 3.5 g/cm$^3$ or more, more preferably 4.0 g/cm$^3$ or more. According to the metal powder for powder metallurgy having such a high tap density, when a molded body is obtained, the packing efficiency between particles is particularly increased. Therefore, a particularly dense sintered body can be obtained in the end.

The specific surface area of the metal powder for powder metallurgy is not particularly limited, but is preferably 0.1 m$^2$/g or more, more preferably 0.2 m$^2$/g or more. According to the metal powder for powder metallurgy having such a large specific surface area, a surface activity (surface energy) is increased so that it is possible to easily sinter the metal powder even if less energy is applied. Therefore, when a molded body is sintered, a difference in sintering rate hardly occurs between the inner side and the outer side of the molded body, and thus, the decrease in the sintered density due to the pores remaining inside the molded body can be suppressed.

Method for Producing Sintered Body

Next, a method for producing a sintered body using such a metal powder for powder metallurgy will be described.

The method for producing a sintered body includes [A] a composition preparation step in which a composition for producing a sintered body is prepared, [B] a molding step in which a molded body is produced, [C] a degreasing step in which a degreasing treatment is performed, and [D] a firing step in which firing is performed. Hereinafter, the respective steps will be described sequentially.

[A] Composition Preparation Step

First, the metal powder for powder metallurgy and a binder are prepared, and these materials are kneaded using a kneader, whereby a kneaded material (an embodiment of the compound according to the invention) is obtained. That is, the kneaded material contains the metal powder for powder metallurgy described above and the binder which binds the particles of the metal powder for powder metallurgy to one another. By using such a kneaded material, a sintered body which simultaneously achieves both a nonmagnetic property and a high strength can be produced.

In this kneaded material, the metal powder for powder metallurgy is uniformly dispersed.

The metal powder for powder metallurgy is produced by, for example, any of a variety of powdering methods such as an atomization method (for example, a water atomization method, a gas atomization method, a spinning water atomization method, etc.), a reducing method, a carbonyl method, and a pulverization method.

Among these, the metal powder for powder metallurgy is preferably a metal powder produced by an atomization method, more preferably a metal powder produced by a water atomization method or a spinning water atomization method. The atomization method is a method in which a molten metal (metal melt) is caused to collide with a fluid (a liquid or a gas) sprayed at a high speed to atomize the metal melt into a fine powder and also to cool the fine powder, whereby a metal powder is produced. By producing the metal powder for powder metallurgy through such an atomization method, an extremely fine powder can be efficiently produced. Further, the shape of the particle of the obtained powder is closer to a spherical shape by the action of surface tension. Due to this, a metal powder having a high packing factor when it is molded is obtained. That is, a powder capable of producing a sintered body having a high density can be obtained.

In the case where a water atomization method is used as the atomization method, the pressure of water (hereinafter referred to as "atomization water") to be sprayed to the molten metal is not particularly limited, but is set to preferably about 75 MPa or more and 120 MPa or less (750 $kgf/cm^2$ or more and 1200 $kgf/cm^2$ or less), more preferably about 90 MPa or more and 120 MPa or less (900 $kgf/cm^2$ or more and 1200 $kgf/cm^2$ or less).

The temperature of the atomization water is also not particularly limited, but is preferably set to about 1° C. or higher and 20° C. or lower.

The atomization water is often sprayed in a cone shape such that it has a vertex on the falling path of the metal melt and the outer diameter gradually decreases downward. In this case, the vertex angle θ of the cone formed by the atomization water is preferably about 100 or more and 40° or less, more preferably about 150 or more and 350 or less. According to this, a metal powder for powder metallurgy having a composition as described above can be reliably produced.

Further, by using a water atomization method (particularly, a spinning water atomization method), the metal melt can be cooled particularly quickly. Due to this, a powder having high quality can be obtained in a wide alloy composition.

Further, the cooling rate when cooling the metal melt in the atomization method is preferably $1\times10^{4\circ}$ C./s or more, more preferably $1\times10^{5\circ}$ C./s or more. By the quick cooling in this manner, a homogeneous metal powder for powder metallurgy is obtained. As a result, a sintered body having high quality can be obtained.

The thus obtained metal powder for powder metallurgy may be classified as needed. Examples of the classification method include dry classification such as sieving classification, inertial classification, and centrifugal classification, and wet classification such as sedimentation classification.

On the other hand, examples of the binder include polyolefins such as polyethylene, polypropylene, and ethylene-vinyl acetate copolymers, acrylic resins such as polymethyl methacrylate and polybutyl methacrylate, styrenic resins such as polystyrene, polyesters such as polyvinyl chloride, polyvinylidene chloride, polyamide, polyethylene terephthalate, and polybutylene terephthalate, various types of resins such as polyether, polyvinyl alcohol, polyvinylpyrrolidone, and copolymers thereof, and various types of organic binders such as various types of waxes, paraffins, higher fatty acids (for example, stearic acid), higher alcohols, higher fatty acid esters, and higher fatty acid amides. Among these, one type can be used or two or more types can be used in admixture.

The content of the binder is preferably about 2 mass % or more and 20 mass % or less, more preferably about 5 mass % or more and 10 mass % or less with respect to the total amount of the kneaded material. By setting the content of the binder within the above range, a molded body can be formed with good moldability, and also the density is increased, whereby the stability of the shape of the molded body and the like can be particularly enhanced. Further, according to this, a difference in size between the molded body and the degreased body, in other words, a so-called shrinkage ratio is optimized, whereby a decrease in the dimensional accuracy of the finally obtained sintered body can be prevented. That is, a sintered body having a high density and high dimensional accuracy can be obtained.

In the kneaded material, a plasticizer may be added as needed. Examples of the plasticizer include phthalate esters (for example, DOP, DEP, and DBP), adipate esters, trimellitate esters, and sebacate esters. Among these, one type can be used or two or more types can be used in admixture.

Further, in the kneaded material, other than the metal powder for powder metallurgy, the binder, and the plasticizer, for example, any of a variety of additives such as a lubricant, an antioxidant, a degreasing accelerator, and a surfactant, or another metal powder, a ceramic powder, or the like can be added as needed.

The kneading conditions vary depending on the respective conditions such as the metal composition or the particle diameter of the metal powder for powder metallurgy to be used, the composition of the binder, and the blending amount thereof. However, for example, the kneading temperature can be set to about 50° C. or higher and 200° C. or lower, and the kneading time can be set to about 15 minutes or more and 210 minutes or less.

Further, the kneaded material is formed into a pellet (small mass) as needed. The particle diameter of the pellet is set to, for example, about 1 mm or more and 15 mm or less.

Incidentally, depending on the molding method described below, in place of the kneaded material, a granulated powder (an embodiment of the granulated powder according to the invention) may be used. The kneaded material, the granulated powder, and the like are examples of the composition to be subjected to the molding step described below.

Such a granulated powder is obtained by binding a plurality of metal particles to one another with a binder by subjecting the metal powder for powder metallurgy to a granulation treatment. That is, the granulated powder is obtained by granulating the above-mentioned metal powder for powder metallurgy. By using such a granulated powder, a sintered body which simultaneously achieves both a non-magnetic property and a high strength can be produced.

Examples of the binder to be used for the production of the granulated powder include polyolefins such as polyethylene, polypropylene, and ethylene-vinyl acetate copolymers, acrylic resins such as polymethyl methacrylate and polybutyl methacrylate, styrenic resins such as polystyrene, polyesters such as polyvinyl chloride, polyvinylidene chloride, polyamide, polyethylene terephthalate, and polybutylene terephthalate, various types of resins such as polyether, polyvinyl alcohol, polyvinylpyrrolidone, and copolymers thereof, and various types of organic binders such as various types of waxes, paraffins, higher fatty acids (for example, stearic acid), higher alcohols, higher fatty acid esters, and higher fatty acid amides. Among these, one type can be used or two or more types can be used in admixture.

Among these, as the binder, a binder containing polyvinyl alcohol or polyvinylpyrrolidone is preferred. These binder components have a high binding ability, and therefore can efficiently form the granulated powder even in a relatively small amount. Further, the thermal decomposability thereof is also high, and therefore, the binder can be reliably decomposed and removed in a short time during degreasing and firing.

The content of the binder is preferably about 0.2 mass % or more and 10 mass % or less, more preferably about 0.3 mass % or more and 5 mass % or less, further more preferably about 0.3 mass % or more and 2 mass % or less with respect to the total amount of the granulated powder. By setting the content of the binder within the above range, a granulated powder can be efficiently formed while preventing significantly large particles from being formed or a large amount of the metal particles which are not granulated from remaining. Further, since the moldability is improved, the stability of the shape of the molded body and the like can be particularly enhanced. Further, by setting the content of the binder within the above range, a difference in size between the molded body and the degreased body, that is, a so-called shrinkage ratio is optimized, whereby a decrease in the dimensional accuracy of the finally obtained sintered body can be prevented.

Further, in the granulated powder, any of a variety of additives such as a plasticizer, a lubricant, an antioxidant, a degreasing accelerator, and a surfactant, or another metal powder, a ceramic powder, or the like may be added as needed.

On the other hand, examples of the granulation treatment include a spray dry method, a tumbling granulation method, a fluidized bed granulation method, and a tumbling fluidized bed granulation method.

In the granulation treatment, a solvent which dissolves the binder is used as needed. Examples of the solvent include inorganic solvents such as water and carbon tetrachloride, and organic solvents such as ketone-based solvents, alcohol-based solvents, ether-based solvents, cellosolve-based solvents, aliphatic hydrocarbon-based solvents, aromatic hydrocarbon-based solvents, aromatic heterocyclic compound-based solvents, amide-based solvents, halogen compound-based solvents, ester-based solvents, amine-based solvents, nitrile-based solvents, nitro-based solvents, and aldehyde-based solvents, and one type or a mixture of two or more types selected from these solvents is used.

The average particle diameter of the granulated powder is not particularly limited, but is preferably about m or more and 200 m or less, more preferably about 20 m or more and 100 m or less, further more preferably about m or more and 60 m or less. The granulated powder having such a particle diameter has favorable fluidity, and can more faithfully reflect the shape of a molding die.

The average particle diameter can be obtained as a particle diameter when the cumulative amount from the small diameter side reaches 50% in a cumulative particle size distribution on a mass basis obtained by laser diffractometry.

[B] Molding Step

Subsequently, the kneaded material or the granulated powder is molded, whereby a molded body having the same shape as that of a target sintered body is produced.

Examples of the molding method include a powder compaction molding (compression molding) method, a metal injection molding (MIM) method, and an extrusion molding method.

The molding conditions in the case of a powder compaction molding method among these methods are preferably such that the molding pressure is about 200 MPa or more and 1000 MPa or less (2 t/cm$^2$ or more and 10 t/cm$^2$ or less), although they vary depending on the respective conditions such as the composition and the particle diameter of the metal powder for powder metallurgy to be used, the composition of the binder, and the blending amount thereof.

Further, the molding conditions in the case of a metal injection molding method are preferably such that the material temperature is about 80° C. or higher and 210° C. or lower, and the injection pressure is about 50 MPa or more and 500 MPa or less (0.5 t/cm$^2$ or more and 5 t/cm$^2$ or less), although they vary depending on the respective conditions.

Further, the molding conditions in the case of an extrusion molding method are preferably such that the material temperature is about 80° C. or higher and 210° C. or lower, and the extrusion pressure is about 50 MPa or more and 500 MPa or less (0.5 t/cm$^2$ or more and 5 t/cm$^2$ or less), although they vary depending on the respective conditions.

The thus obtained molded body is in a state where the binder is uniformly distributed in the gaps between the particles of the metal powder.

The shape and size of the molded body to be produced are determined in anticipation of shrinkage of the molded body in the subsequent degreasing step and firing step.

[C] Degreasing Step

Subsequently, the thus obtained molded body is subjected to a degreasing treatment (binder removal treatment), whereby a degreased body is obtained. Specifically, the degreasing treatment is performed by heating the molded body to decompose the binder, thereby removing the binder from the molded body.

Examples of the degreasing treatment include a method of heating the molded body and a method of exposing the molded body to a gas capable of decomposing the binder.

In the case of using a method of heating the molded body, the conditions for heating the molded body are preferably such that the temperature is about 100° C. or higher and 750° C. or lower and the time is about 0.1 hours or more and 20 hours or less, and more preferably such that the temperature is about 150° C. or higher and 600° C. or lower and the time is about 0.5 hours or more and 15 hours or less, although they slightly vary depending on the composition and the blending amount of the binder. According to this, the degreasing of the molded body can be necessarily and sufficiently performed without sintering the molded body. As a result, it is possible to reliably prevent a large amount of the binder component from remaining inside the degreased body.

The atmosphere when the molded body is heated is not particularly limited, and examples thereof include a reducing gas atmosphere such as hydrogen, an inert gas atmosphere such as nitrogen or argon, an oxidizing gas atmosphere such as air, and a reduced pressure atmosphere obtained by reducing the pressure of such an atmosphere.

Examples of the gas capable of decomposing the binder include ozone gas.

Incidentally, by dividing such a degreasing step into a plurality of steps in which the degreasing conditions are different, and performing the plurality of steps, the binder in the molded body can be more rapidly decomposed and removed so that the binder does not remain in the molded body.

Further, according to need, the degreased body may be subjected to machining such as grinding, polishing, or cutting. The degreased body has a relatively low hardness and relatively high plasticity, and therefore, machining can be easily performed while preventing the degreased body from losing its shape. According to such machining, a sintered body having high dimensional accuracy can be easily obtained in the end.

(D) Firing Step

The degreased body obtained in the above step (C) is fired in a firing furnace, whereby a sintered body is obtained.

By this firing, in the metal powder for powder metallurgy, diffusion occurs at the boundary surface between the particles, resulting in sintering. At this time, by the mechanism as described above, the degreased body is rapidly sintered. As a result, a sintered body which is dense and has a high density on the whole is obtained.

The firing temperature varies depending on the composition, the particle diameter, and the like of the metal powder for powder metallurgy used in the production of the molded body and the degreased body, but is set to, for example, about 980° C. or higher and 1330° C. or lower, and preferably set to about 1050° C. or higher and 1260° C. or lower.

Further, the firing time is set to 0.2 hours or more and 7 hours or less, but is preferably set to about 1 hour or more and 6 hours or less.

In the firing step, the firing temperature or the below-described firing atmosphere may be changed in the middle of the step.

By setting the firing conditions within such a range, it is possible to sufficiently sinter the entire degreased body while preventing the sintering from proceeding excessively to cause oversintering and increase the size of the crystal structure. As a result, a sintered body having a high density and particularly excellent mechanical characteristics can be obtained.

Further, the thus produced sintered body may be subjected to an additional treatment as needed. Examples of the additional treatment include a solid solution treatment, an age hardening treatment, a double aging treatment, a sub-zero treatment, a tempering treatment, a hot working treatment, and a cold working treatment, and among these, one treatment is used or two or more treatments are used in combination.

Specific examples of the additional treatment described above include a treatment in which a solid solution treatment is performed by cooling from a temperature of 1000° C. or higher and 1250° C. or lower for a time of 30 minutes or more and 120 minutes or less, and thereafter, an age hardening treatment is performed by cooling from a temperature of 600° C. or higher and 800° C. or lower for a time of 6 hours or more and 48 hours or less.

The thus produced sintered body (the sintered body according to the embodiment) is a sintered body which contains Fe as a principal component, Cr in a proportion of 11.0 mass % or more and 25.0 mass % or less, Ni in a proportion of 8.0 mass % or more and 30.0 mass % or less, Si in a proportion of 0.20 mass % or more and 1.2 mass % or less, C in a proportion of 0.070 mass % or more and 0.40 mass % or less, Mn in a proportion of 0.10 mass % or more and 2.0 mass % or less, P in a proportion of 0.10 mass % or more and 0.50 mass % or less, and at least one of W and Nb in a proportion of 0.20 mass % or more and 3.0 mass % or less in total.

According to such a sintered body, both a nonmagnetic property and a high mechanical strength can be simultaneously achieved. Therefore, for example, when the obtained sintered body is applied to at least some of the components to be used in an electronic device, the components which are made nonmagnetic, and also exhibit a sufficient strength even if the components are miniaturized or thinned can be realized. Further, a sintered body to be produced is produced by powder metallurgy, and therefore has high dimensional accuracy and also is capable of omitting secondary processing or suppressing the processing amount. Due to this, there is a low possibility of causing magnetism accompanying processing, and also from this viewpoint, the obtained sintered body exhibits a nonmagnetic property.

Further, it is preferred that the sintered body according to the embodiment has a magnetic permeability of 1.05 or less and a tensile strength of 800 MPa or more. Such a sintered body simultaneously achieves both a nonmagnetic property and high mechanical characteristics (high strength) at a high level. Therefore, for example, when the sintered body is applied to a component or the like of an electronic device which is sufficiently thinned, the component can be thinned and light-weighted while making the component nonmagnetic. As a result, for example, the electronic device can be thinned and light-weighted while preventing the magnetism of the component from adversely affecting high-speed and large-capacity wireless communication in the electronic device.

The magnetic permeability of the sintered body is set to preferably 1.03 or less, more preferably 1.02 or less.

The magnetic permeability of the sintered body is obtained as a relative permeability calculated from a magnetic characteristic curve representing a relationship between a magnetic field strength and a magnetic flux density at that time acquired using, for example, a vibrating sample magnetometer (manufactured by Tamakawa Co. Ltd.). The maximum magnetic field strength is set to, for example, 1.2 mA/m (1.5 T).

On the other hand, the tensile strength of the sintered body is set to preferably 950 MPa or more, more preferably 1050 MPa or more.

The tensile strength of the sintered body is measured, for example, in accordance with the metal material tensile test method specified in JIS Z 2241 (2011).

The surface of the thus produced sintered body has a high hardness. Specifically, for example, the surface Vickers hardness of the sintered body is expected to be 250 or more and 700 or less, although it slightly varies depending on the composition of the metal powder for powder metallurgy. Further, preferably, the surface Vickers hardness is expected to be 290 or more and 600 or less. The sintered body having such a hardness has particularly high mechanical characteristics.

The Vickers hardness of the sintered body is measured, for example, in accordance with the Vickers hardness test method specified in JIS Z 2244 (2009).

In the firing step or a variety of additional treatments described above, a light element in the metal powder (in the sintered body) is volatilized, and the composition of the finally obtained sintered body slightly changes from the composition of the metal powder in some cases.

For example, the content of C in the final sintered body may change within the range of 5% or more and less than 100% (preferably within the range of 30% or more and less than 100%) of the content of C in the metal powder for powder metallurgy, although it varies depending on the conditions for the step or the conditions for the treatment.

Further, also the content of O in the final sintered body may change within the range of 1% or more and 50% or less (preferably within the range of 3% or more and 50% or less) of the content of 0 in the metal powder for powder metallurgy, although it varies depending on the conditions for the step or the conditions for the treatment.

Hereinabove, the metal powder for powder metallurgy, the compound, the granulated powder, and the sintered body according to the invention have been described with reference to preferred embodiments, however, the invention is not limited thereto.

Further, the sintered body according to the invention is used for, for example, components for transport devices such as components for automobiles, components for bicycles, components for railroad cars, components for ships, components for airplanes, and components for space transport devices (such as rockets), components for electronic devices such as components for personal computers, components for cellular phone terminals, components for tablet terminals, and components for wearable terminals, components for electrical devices such as refrigerators, washing machines, and cooling and heating devices, components for machines such as machine tools and semiconductor production devices, components for plants such as atomic power plants, thermal power plants, hydroelectric power plants, oil refinery plants, and chemical complexes, ornaments such as components for timepieces, metallic tableware, jewels, and frames for glasses, and all other sorts of structural components.

EXAMPLES

Next, Examples of the invention will be described.

1. Production of Sintered Body

Sample No. 1

[1] First, a metal powder having a composition shown in Table 1 produced by a water atomization method was prepared.

The composition of the powder shown in Table 1 was identified and quantitatively determined by inductively coupled high-frequency plasma optical emission spectrometry (ICP analysis). In the ICP analysis, an ICP device, model: CIROS-120 manufactured by Rigaku Corporation was used. Further, in the identification and quantitative determination of C, a carbon-sulfur analyzer CS-200 manufactured by LECO Corporation was used. Further, in the identification and quantitative determination of O, an oxygen-nitrogen analyzer TC-300/EF-300 manufactured by LECO Corporation was used.

[2] Subsequently, the metal powder and a mixture (as an organic binder) of polypropylene and a wax were weighed at a mass ratio of 9:1 and mixed with each other, whereby a mixed raw material was obtained.

[3] Subsequently, this mixed raw material was kneaded using a kneader, whereby a compound was obtained.

[4] Subsequently, this compound was molded using an injection molding machine under the following molding conditions, whereby a molded body was produced.

Molding Conditions

Material temperature: 150° C.

Injection pressure: 11 MPa (110 kgf/cm$^2$)

[5] Subsequently, the obtained molded body was subjected to a heat treatment under the following degreasing conditions, whereby a degreased body was obtained.

Degreasing Conditions

Degreasing temperature: 500° C.

Degreasing time: 1 hour (retention time at the degreasing temperature)

Degreasing atmosphere: nitrogen atmosphere

[6] Subsequently, the obtained degreased body was fired under the following firing conditions, whereby a sintered body was obtained. The shape of the sintered body was determined to be a circular cylindrical shape with a diameter of 10 mm and a thickness of 5 mm.

Firing Conditions

Firing temperature: 1300° C.

Firing time: 3 hours (retention time at the firing temperature)

Firing atmosphere: argon atmosphere

[7] Subsequently, the obtained sintered body was sequentially subjected to a solid solution treatment and an age hardening treatment under the following conditions.

Conditions for Solid Solution Treatment

Heating temperature: 1120° C.

Heating time: 30 minutes

Cooling method: water cooling

Conditions for Age Hardening Treatment

Heating temperature: 700° C.

Heating time: 24 hours

Cooling method: water cooling

Sample Nos. 2 to 26

Sintered bodies were obtained in the same manner as in the case of the sample No. 1 except that the composition and the like of the metal powder for powder metallurgy were changed as shown in Table 1, respectively. Each of the sintered bodies of the sample Nos. 19 and 20 was obtained using the metal powder produced by a gas atomization method, and "Gas" is entered in the column of Remarks in Table 1.

TABLE 1

| | | Metal powder for powder metallurgy Alloy composition | | | | | | | | | | |
|---|---|---|---|---|---|---|---|---|---|---|---|---|
| Sample No. | — | Cr | Ni | Si | C | Mn | P | W | Nb | Cu | Al | Fe |
| | | mass % | | | | | | | | | | |
| No. 1 | Ex. | 18.2 | 10.0 | 0.35 | 0.26 | 0.90 | 0.25 | 0.75 | | | | Remainder |
| No. 2 | Ex. | 17.0 | 11.3 | 0.40 | 0.30 | 0.80 | 0.20 | 0.90 | | | | Remainder |
| No. 3 | Ex. | 19.3 | 9.2 | 0.30 | 0.21 | 0.99 | 0.28 | 0.67 | | | | Remainder |
| No. 4 | Ex. | 15.7 | 13.5 | 0.52 | 0.36 | 1.20 | 0.42 | 0.45 | | | | Remainder |
| No. 5 | Ex. | 20.5 | 8.4 | 0.64 | 0.18 | 0.64 | 0.18 | 0.80 | | | | Remainder |
| No. 6 | Ex. | 18.5 | 9.6 | 0.31 | 0.28 | 0.82 | 0.28 | 1.27 | | | | Remainder |
| No. 7 | Ex. | 17.6 | 11.0 | 0.48 | 0.23 | 0.77 | 0.32 | 0.70 | | | | Remainder |
| No. 8 | Ex. | 18.0 | 14.5 | 0.37 | 0.12 | 0.31 | 0.23 | 0.90 | | 2.80 | | Remainder |
| No. 9 | Ex. | 21.8 | 23.4 | 0.22 | 0.15 | 0.30 | 0.15 | 0.45 | | | 3.20 | Remainder |
| No. 10 | Ex. | 17.9 | 10.2 | 0.36 | 0.25 | 0.88 | 0.24 | 0.36 | 0.36 | | | Remainder |
| No. 11 | Ex. | 18.5 | 10.5 | 0.41 | 0.26 | 0.92 | 0.11 | 1.12 | 0.58 | | | Remainder |
| No. 12 | Ex. | 12.0 | 14.0 | 0.20 | 0.15 | 0.17 | 0.16 | | 0.72 | | | Remainder |
| No. 13 | Ex. | 18.5 | 9.4 | 0.31 | 0.22 | 1.10 | 0.31 | | 0.92 | | | Remainder |
| No. 14 | Ex. | 20.5 | 8.6 | 0.55 | 0.15 | 0.58 | 0.45 | | 0.48 | | | Remainder |
| No. 15 | Ex. | 19.2 | 10.6 | 0.28 | 0.23 | 0.88 | 0.24 | 0.61 | | | | Remainder |
| No. 16 | Ex. | 17.8 | 10.5 | 0.37 | 0.28 | 0.85 | 0.28 | 0.56 | 0.35 | | | Remainder |
| No. 17 | Ex. | 21.2 | 27.5 | 1.05 | 0.28 | 1.48 | 0.32 | 0.25 | | 3.50 | | Remainder |
| No. 18 | Ex. | 16.0 | 25.0 | 0.24 | 0.18 | 0.12 | 0.44 | 0.52 | 0.84 | | 0.35 | Remainder |
| No. 19 | Ex. | 18.2 | 10.0 | 0.35 | 0.26 | 0.90 | 0.25 | 0.75 | | | | Remainder |
| No. 20 | Ex. | 17.9 | 10.2 | 0.36 | 0.25 | 0.88 | 0.24 | 0.36 | 0.36 | | | Remainder |

TABLE 1-continued

| | | | | | | | | | | | |
|---|---|---|---|---|---|---|---|---|---|---|---|
| No. 21 | Comp. Ex. | 18.5 | 9.7 | 0.32 | 0.21 | 0.95 | 0.23 | 0.15 | | | Remainder |
| No. 22 | Comp. Ex. | 17.7 | 10.6 | 0.34 | 0.29 | 0.84 | 0.29 | 3.25 | | | Remainder |
| No. 23 | Comp. Ex. | 19.5 | 9.4 | 0.31 | 0.25 | 0.75 | 0.25 | | 0.12 | | Remainder |
| No. 24 | Comp. Ex. | 18.3 | 11.2 | 0.48 | 0.31 | 1.12 | 0.41 | | 3.64 | | Remainder |
| No. 25 | Comp. Ex. | 17.7 | 10.6 | 0.34 | 0.29 | 0.84 | 0.29 | 0.03 | 0.02 | | Remainder |
| No. 26 | Comp. Ex. | 17.9 | 10.1 | 0.41 | 0.24 | 0.88 | 0.25 | 1.56 | 1.69 | | Remainder |

| | | Metal powder for powder metallurgy | | | | | |
|---|---|---|---|---|---|---|---|
| | Sample No. | W + Nb mass % | W/Nb — | (W + Nb)/C mass % | (W + Nb)/P — | Molding method — | Remarks — |
| | No. 1 | 0.75 | — | 2.88 | 3.00 | Injection molding | |
| | No. 2 | 0.90 | — | 3.00 | 4.50 | Injection molding | |
| | No. 3 | 0.67 | — | 3.19 | 2.39 | Injection molding | |
| | No. 4 | 0.45 | — | 1.25 | 1.07 | Injection molding | |
| | No. 5 | 0.80 | — | 4.44 | 4.44 | Injection molding | |
| | No. 6 | 1.27 | — | 4.54 | 4.54 | Injection molding | |
| | No. 7 | 0.70 | — | 3.04 | 2.19 | Injection molding | |
| | No. 8 | 0.90 | — | 7.50 | 3.91 | Injection molding | |
| | No. 9 | 0.45 | — | 3.00 | 3.00 | Injection molding | |
| | No. 10 | 0.72 | 1.00 | 2.88 | 3.00 | Injection molding | |
| | No. 11 | 1.70 | 1.93 | 6.54 | 15.45 | Injection molding | N: 0.10 |
| | No. 12 | 0.72 | 0.00 | 4.80 | 4.50 | Injection molding | |
| | No. 13 | 0.92 | 0.00 | 4.18 | 2.97 | Injection molding | |
| | No. 14 | 0.48 | 0.00 | 3.20 | 1.07 | Injection molding | |
| | No. 15 | 0.61 | — | 2.65 | 2.54 | Injection molding | V: 0.42 |
| | No. 16 | 0.91 | 1.60 | 3.25 | 3.25 | Injection molding | Mo: 0.31 |
| | No. 17 | 0.25 | — | 0.89 | 0.78 | Injection molding | Mo: 2.90 |
| | No. 18 | 1.36 | 0.62 | 7.56 | 3.09 | Injection molding | Ti: 3.8<br>B: 0.06<br>Zr: 0.05 |
| | No. 19 | 0.75 | — | 2.88 | 3.00 | Injection molding | Gas |
| | No. 20 | 0.72 | 1.00 | 2.88 | 3.00 | Injection molding | Gas |
| | No. 21 | 0.15 | — | 0.71 | 0.65 | Injection molding | |
| | No. 22 | 3.25 | — | 11.21 | 11.21 | Injection molding | |
| | No. 23 | 0.12 | 0.00 | 0.48 | 0.48 | Injection molding | |
| | No. 24 | 3.6 | 0.00 | 11.7 | 8.88 | Injection molding | |
| | No. 25 | 0.05 | 1.50 | 0.17 | 0.17 | Injection molding | |
| | No. 26 | 3.25 | 0.92 | 13.54 | 13.00 | Injection molding | |

In Table 1, among the metal powders for powder metallurgy and the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities or oxygen, but the description thereof in Table 1 is omitted.

Sample No. 27

[1] First, a metal powder having a composition shown in Table 2 was produced by a water atomization method in the same manner as in the case of the sample No. 1.

[2] Subsequently, the metal powder was granulated by a spray dry method. The binder used at this time was polyvinyl alcohol, which was used in an amount of 1 part by mass with respect to 100 parts by mass of the metal powder. Further, a solvent (ion exchanged water) was used in an amount of 50 parts by mass with respect to 1 part by mass of polyvinyl alcohol. In this manner, a granulated powder having an average particle diameter of 50 μm was obtained.

[3] Subsequently, this granulated powder was subjected to powder compaction molding under the following molding conditions. In this molding, a press molding machine was used.

Molding Conditions

Material temperature: 90° C.

Molding pressure: 600 MPa (6 t/cm$^2$)

[4] Subsequently, the obtained molded body was subjected to a heat treatment (degreasing treatment) under the following degreasing conditions, whereby a degreased body was obtained.

Degreasing Conditions

Degreasing temperature: 450° C.

Degreasing time: 2 hours (retention time at the degreasing temperature)

Degreasing atmosphere: nitrogen atmosphere

[5] Subsequently, the obtained degreased body was fired under the following firing conditions, whereby a sintered body was obtained. The shape of the sintered body was determined to be a circular cylindrical shape with a diameter of 10 mm and a thickness of 5 mm.

Firing Conditions

Firing temperature: 1300° C.

Firing time: 3 hours (retention time at the firing temperature)

Firing atmosphere: argon atmosphere

[6] Subsequently, the obtained sintered body was sequentially subjected to a solid solution treatment and an age hardening treatment under the following conditions.

Conditions for Solid Solution Treatment

Heating temperature: 1120° C.

Heating time: 30 minutes

Cooling method: water cooling

Conditions for Age Hardening Treatment

Heating temperature: 700° C.

Heating time: 24 hours

Cooling method: water cooling

Sample Nos. 28 to 37

Sintered bodies were obtained in the same manner as in the case of the sample No. 27 except that the composition and the like of the metal powder for powder metallurgy were changed as shown in Table 2, respectively.

TABLE 2

| | | Metal powder for powder metallurgy Alloy composition | | | | | | | | | | |
|---|---|---|---|---|---|---|---|---|---|---|---|---|
| Sample No. | — | Cr | Ni | Si | C | Mn | P | W | Nb | Cu | Al | Fe |
| | | mass % | | | | | | | | | | |
| No. 27 | Ex. | 18.2 | 10.0 | 0.35 | 0.26 | 0.90 | 0.25 | 0.75 | | | | Remainder |
| No. 28 | Ex. | 15.7 | 13.5 | 0.52 | 0.36 | 1.20 | 0.42 | 0.45 | | | | Remainder |
| No. 29 | Ex. | 18.5 | 9.6 | 0.31 | 0.28 | 0.82 | 0.28 | 1.27 | | | | Remainder |
| No. 30 | Ex. | 17.9 | 10.2 | 0.36 | 0.25 | 0.88 | 0.24 | 0.36 | 0.36 | | | Remainder |
| No. 31 | Ex. | 18.5 | 9.4 | 0.31 | 0.22 | 1.10 | 0.31 | | 0.92 | | | Remainder |
| No. 32 | Comp. Ex. | 18.5 | 9.7 | 0.32 | 0.21 | 0.95 | 0.23 | 0.15 | | | | Remainder |
| No. 33 | Comp. Ex. | 17.7 | 10.6 | 0.34 | 0.29 | 0.84 | 0.29 | 3.25 | | | | Remainder |
| No. 34 | Comp. Ex. | 19.5 | 9.4 | 0.31 | 0.25 | 0.75 | 0.25 | | 0.12 | | | Remainder |
| No. 35 | Comp. Ex. | 18.3 | 11.2 | 0.48 | 0.31 | 1.12 | 0.41 | | 3.64 | | | Remainder |
| No. 36 | Comp. Ex. | 17.7 | 10.6 | 0.34 | 0.29 | 0.84 | 0.29 | 0.03 | 0.02 | | | Remainder |
| No. 37 | Comp. Ex. | 17.9 | 10.1 | 0.41 | 0.24 | 0.88 | 0.25 | 1.56 | 1.69 | | | Remainder |

| | Metal powder for powder metallurgy | | | | | |
|---|---|---|---|---|---|---|
| Sample No. | W + Nb mass % | W/Nb — | (W + Nb)/C mass % | (W + Nb)/P — | Molding method — | Remarks — |
| No. 27 | 0.75 | — | 2.88 | 3.00 | powder compaction molding | |
| No. 28 | 0.45 | — | 1.25 | 1.07 | powder compaction molding | |
| No. 29 | 1.27 | — | 4.54 | 4.54 | powder compaction molding | |
| No. 30 | 0.72 | 1.00 | 2.88 | 3.00 | powder compaction molding | |

TABLE 2-continued

| | | | | | |
|---|---|---|---|---|---|
| No. 31 | 0.92 | 0.00 | 4.18 | 2.97 | powder compaction molding |
| No. 32 | 0.15 | — | 0.71 | 0.65 | powder compaction molding |
| No. 33 | 3.25 | — | 11.21 | 11.21 | powder compaction molding |
| No. 34 | 0.12 | 0.00 | 0.48 | 0.48 | powder compaction molding |
| No. 35 | 3.6 | 0.00 | 11.7 | 8.88 | powder compaction molding |
| No. 36 | 0.05 | 1.50 | 0.17 | 0.17 | powder compaction molding |
| No. 37 | 3.25 | 0.92 | 13.54 | 13.00 | powder compaction molding |

In Table 2, among the metal powders for powder metallurgy and the sintered bodies of the respective sample Nos., those corresponding to the invention are denoted by "Ex." (Example), and those not corresponding to the invention are denoted by "Comp. Ex." (Comparative Example).

Further, each sintered body contained very small amounts of impurities and oxygen, but the description thereof in Table 2 is omitted.

2. Evaluation of Sintered Body 2.1 Evaluation of Magnetic Permeability

With respect to the sintered bodies of the respective sample Nos. shown in Tables 1 and 2, a magnetic characteristic curve representing a relationship between a magnetic field strength and a magnetic flux density at that time was acquired using a vibrating sample magnetometer (manufactured by Tamakawa Co. Ltd.).

Subsequently, a relative permeability was calculated from the acquired magnetic characteristic curve. The maximum magnetic field strength during the measurement was set to 1.2 mA/m (1.5 T).

Then, the calculated relative permeability was evaluated in the light of the following evaluation criteria.

Evaluation Criteria for Relative Permeability

A: The relative permeability of the sintered body is less than 1.005.

B: The relative permeability of the sintered body is 1.005 or more and less than 1.020.

C: The relative permeability of the sintered body is 1.020 or more and less than 1.035.

D: The relative permeability of the sintered body is 1.035 or more and less than 1.050.

E: The relative permeability of the sintered body is 1.050 or more and less than 1.065.

F: The relative permeability of the sintered body is 1.065 or more.

The above evaluation results are shown in Tables 3 and 4.

2.2 Evaluation of Tensile Strength

With respect to the sintered bodies of the respective sample Nos. shown in Tables 1 and 2, the tensile strength was measured in accordance with the metal material tensile test method specified in JIS Z 2241 (2011).

Then, the measured tensile strength was evaluated in the light of the following evaluation criteria.

Evaluation Criteria for Tensile Strength

A: The tensile strength of the sintered body is 1000 MPa or more.

B: The tensile strength of the sintered body is 900 MPa or more and less than 1000 MPa.

C: The tensile strength of the sintered body is 800 MPa or more and less than 900 MPa.

D: The tensile strength of the sintered body is 700 MPa or more and less than 800 MPa.

E: The tensile strength of the sintered body is 600 MPa or more and less than 700 MPa.

F: The tensile strength of the sintered body is less than 600 MPa.

The above evaluation results are shown in Tables 3 and 4.

2.3 Evaluation of Corrosion Resistance

With respect to the sintered bodies of the respective sample Nos. shown in Tables 1 and 2, the corrosion degree was measured in accordance with the sulfuric acid corrosion test method for stainless steels specified in JIS G 0591 (2012). As sulfuric acid, boiled 5 mass % sulfuric acid was used.

Subsequently, with respect to the corrosion degree of each of the sintered bodies of the respective sample Nos. shown in Table 1, the relative value when the corrosion degree (unit: $g/m^2/h$) measured for the sintered body of the sample No. 22 was taken as 1 was calculated.

Further, with respect to the corrosion degree of each of the sintered bodies of the respective sample Nos. shown in Table 2, the relative value when the corrosion degree (unit: $g/m^2/h$) measured for the sintered body of the sample No. 33 was taken as 1 was calculated.

Then, the calculated relative value was evaluated in the light of the following evaluation criteria.

Evaluation Criteria for Corrosion Degree

A: The relative value of the corrosion degree of the sintered body is less than 0.50.

B: The relative value of the corrosion degree of the sintered body is 0.50 or more and less than 0.75.

C: The relative value of the corrosion degree of the sintered body is 0.75 or more and less than 1.00.

D: The relative value of the corrosion degree of the sintered body is 1.00 or more and less than 1.25.

E: The relative value of the corrosion degree of the sintered body is 1.25 or more and less than 1.50.

F: The relative value of the corrosion degree of the sintered body is 1.50 or more.

The above evaluation results are shown in Tables 3 and 4.

TABLE 3

| Sample No. | — | Metal powder Average particle diameter μm | Evaluation results of sintered body: Magnetic permeability — | Tensile strength — | Corrosion resistance — |
|---|---|---|---|---|---|
| No. 1 | Ex. | 6.05 | A | A | A |
| No. 2 | Ex. | 6.77 | A | A | A |
| No. 3 | Ex. | 5.45 | A | A | A |
| No. 4 | Ex. | 4.36 | A | C | A |

TABLE 3-continued

| Sample No. | — | Metal powder Average particle diameter μm | Evaluation results of sintered body Magnetic permeability — | Tensile strength — | Corrosion resistance — |
|---|---|---|---|---|---|
| No. 5 | Ex. | 7.23 | B | B | B |
| No. 6 | Ex. | 6.85 | A | B | A |
| No. 7 | Ex. | 4.25 | A | B | A |
| No. 8 | Ex. | 4.77 | A | C | A |
| No. 9 | Ex. | 4.81 | B | C | B |
| No. 10 | Ex. | 5.85 | A | A | A |
| No. 11 | Ex. | 12.5 | B | C | C |
| No. 12 | Ex. | 8.65 | B | B | C |
| No. 13 | Ex. | 10.5 | B | A | A |
| No. 14 | Ex. | 5.92 | C | B | B |
| No. 15 | Ex. | 4.56 | A | A | B |
| No. 16 | Ex. | 3.68 | A | A | A |
| No. 17 | Ex. | 2.56 | B | C | C |
| No. 18 | Ex. | 6.23 | B | B | C |
| No. 19 | Ex. | 15.3 | A | A | A |
| No. 20 | Ex. | 20.6 | A | A | A |
| No. 21 | Comp. Ex. | 6.25 | C | E | C |
| No. 22 | Comp. Ex. | 6.12 | F | D | D |
| No. 23 | Comp. Ex. | 5.87 | C | F | C |
| No. 24 | Comp. Ex. | 7.25 | F | D | D |
| No. 25 | Comp. Ex. | 7.08 | C | D | C |
| No. 26 | Comp. Ex. | 6.85 | E | D | E |

TABLE 4

| Sample No. | — | Metal powder Average particle diameter μm | Evaluation results of body sintered Magnetic permeability — | Tensile strength — | Corrosion resistance — |
|---|---|---|---|---|---|
| No. 27 | Ex. | 6.05 | A | A | A |
| No. 28 | Ex. | 4.36 | A | C | A |
| No. 29 | Ex. | 6.85 | A | B | A |
| No. 30 | Ex. | 5.85 | A | A | A |
| No. 31 | Ex. | 10.5 | B | A | A |
| No. 32 | Comp. Ex. | 6.25 | A | E | C |
| No. 33 | Comp. Ex. | 6.12 | F | D | D |
| No. 34 | Comp. Ex. | 5.87 | A | F | C |

TABLE 4-continued

| Sample No. | — | Metal powder Average particle diameter μm | Evaluation results of body sintered Magnetic permeability — | Tensile strength — | Corrosion resistance — |
|---|---|---|---|---|---|
| No. 35 | Comp. Ex. | 7.25 | F | D | D |
| No. 36 | Comp. Ex. | 7.08 | A | D | C |
| No. 37 | Comp. Ex. | 6.82 | E | D | E |

As apparent from Tables 3 and 4, it was confirmed that the sintered bodies of Examples have a low magnetic permeability and a favorable nonmagnetic property. The sintered bodies of Examples each had an austenite crystal structure.

Further, it was confirmed that the sintered bodies of Examples have a higher tensile strength and more excellent mechanical characteristics than the sintered bodies of Comparative Examples.

In addition, the sintered bodies of Examples had relatively favorable corrosion resistance.

The entire disclosure of Japanese Patent Application No. 2018-042268 filed Mar. 8, 2018 is expressly incorporated herein by reference.

What is claimed is:

1. A metal powder for powder metallurgy, comprising:

Fe as a principal component;

Cr in a proportion of 11.0 mass % or more and 25.0 mass % or less;

Ni in a proportion of 8.0 mass % or more and 30.0 mass % or less;

Si in a proportion of 0.20 mass % or more and 1.2 mass % or less;

C in a proportion of 0.070 mass % or more and 0.40 mass % or less;

Mn in a proportion of 0.10 mass % or more and 2.0 mass % or less;

P in a proportion of 0.10 mass % or more and 0.50 mass % or less;

at least one of W and Nb in a proportion of 0.20 mass % or more and 3.0 mass % or less in total;

V in a proportion of 3.0 mass %; and

B in a proportion of 0.20 mass %.

* * * * *